US005904078A

United States Patent [19]

Gustafson et al.

[11] Patent Number: 5,904,078

[45] Date of Patent: May 18, 1999

[54] PLIERS WITH FLUSH JOINT BIAS SPRING

[75] Inventors: Eric T. Gustafson, Kenosha; Christopher D. Thompson, Milwaukee, both of Wis.

[73] Assignee: Snap-on Technologies, Inc., Lincolnshire, Ill.

[21] Appl. No.: 08/901,172

[22] Filed: Jul. 28, 1997

[51] Int. Cl.[6] ..... B25B 7/06

[52] U.S. Cl. ..... 81/417; 81/416; 81/405; 81/407; 30/261

[58] Field of Search ..... 81/415–417, 393–394, 81/405–408, 411–412; 30/234, 261; 403/291, 111, 146

[56] References Cited

U.S. PATENT DOCUMENTS

| | | | |
|---|---|---|---|
| 908,947 | 1/1909 | Burkhart . | |
| 1,657,348 | 1/1928 | Drumm . | |
| 1,763,527 | 11/1930 | Jones . | |
| 1,895,314 | 1/1933 | Dripps . | |
| 2,392,118 | 1/1946 | Cacarillo . | |
| 3,176,551 | 4/1965 | Hansen . | |
| 3,575,070 | 4/1971 | Nichols . | |
| 4,203,208 | 5/1980 | Tausendfreundt et al. | 30/261 |
| 4,296,655 | 10/1981 | Tesoro . | |
| 4,669,340 | 6/1987 | Igarashi . | |
| 4,719,827 | 1/1988 | Igarashi . | |
| 4,903,558 | 2/1990 | le Duc . | |
| 4,987,626 | 1/1991 | Montgomery et al. . | |
| 5,140,876 | 8/1992 | Fields . | |
| 5,168,629 | 12/1992 | Willard | 30/231 |
| 5,628,115 | 5/1997 | Hebert | 30/261 |

*Primary Examiner*—D. S. Meislin
*Attorney, Agent, or Firm*—Emrich & Dithmar

[57] ABSTRACT

A slip-joint pliers has crossed pivoting levers joined at pivot portions thereof by a flat-sided bolt extending through openings in the levers and engaged with a nut, one of the openings being elongated and generally dumbbell-shaped to accommodate the slip-joint movement. The pivot portions of the levers have flat facing inner surfaces, in each of which is formed a single-level spring recess surrounding the associated opening, each recess having a peripheral side wall and a flat planar bottom wall extending from the side wall to the associated opening. A helical torsion spring is seated in the recesses and encircles the bolt and has tangent ends respectively engageable with straight bearing portions of the recesses.

18 Claims, 2 Drawing Sheets

PLIERS WITH FLUSH JOINT BIAS SPRING

BACKGROUND OF THE INVENTION

1. Field of the Invention

The present invention relates to hand tools, such as pliers, and relates in particular to slip-joint pliers incorporating a bias mechanism to resiliently bias the pliers to an open condition.

2. Description of the Prior Art

In slip-joint pliers the two levers of the pliers are joined by a pivot shaft, such as a bolt, extending through holes in the pivot portions of the two levers, one of the holes substantially matching the cross-sectional size and shape of the shaft, and the other hole being elongated so as to accommodate a lateral shifting of the associated lever among different positions relative to the shaft.

Heretofore, it has been known to provide a bias mechanism for resiliently biasing pliers levers to an open condition for working convenience, such bias mechanism commonly being in the form of a torsion spring partially or completely encircling the pivot shaft. The use of such a bias mechanism in slip-joint pliers is disclosed, for example, in U.S. Pat. Nos. 1,657,348 to Drum and 4,669,340 to Igarashi, the former disposing the bias spring between the levers in recesses formed in the facing surfaces of the levers. However, in each of these devices, the ends of the spring are, respectively, turned outwardly in directions substantially perpendicular to the plane of the spring coil and are accommodated in bores or grooves in the recesses. This requires not only the formation of a spring with appropriately bent ends, but also requires the formation of multi-level recesses with additional bores or grooves formed therein, adding to the expense of manufacture.

A biasing torsion spring in a non-slip-joint crossed-lever tool is disclosed in U.S. Pat. No. 2,392,118 to Cacarillo. In this device the spring ends are tangent to the coil and are not inclined to the plane of the coil, but the spring recesses have central bosses formed therein to separate the spring from the pivot shaft, and also have narrow arms extending outwardly from the main body of the recess substantially tangent thereto for respectively receiving the spring ends. Again, this complex recess construction adds to the expense of manufacture of the tool.

SUMMARY OF THE INVENTION

It is a general object of the present invention to provide an improved hand tool of the spring-biased, crossed, pivoting lever type, which avoids the disadvantages of prior tools while affording additional structural and operating advantages.

An important feature of the invention is the provision of a hand tool of the type set forth which is of relatively simple and economical construction.

In connection with the foregoing feature, another feature of the invention is the provision of a hand tool of the type set forth, wherein the bias spring is seated in single-level, non-reentrant recesses in the levers.

Certain ones of these and other features are attained by providing a hand tool comprising: first and second crossed levers respectively having facing first and second inner surfaces and first and second openings respectively formed through the first and second levers at the first and second inner surfaces, a pivot shaft extending through the openings for pivotally interconnecting the levers, first and second recesses respectively formed in the inner surfaces and respectively surrounding the openings, each of the recesses having a peripheral side wall including a substantially flat planar bearing portion and a substantially flat planar bottom wall extending from the side wall to the associated opening, and a bias spring disposed in the recesses and having first and second ends respectively engaging the bearing portions for resiliently pivotally urging the levers to a predetermined condition.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
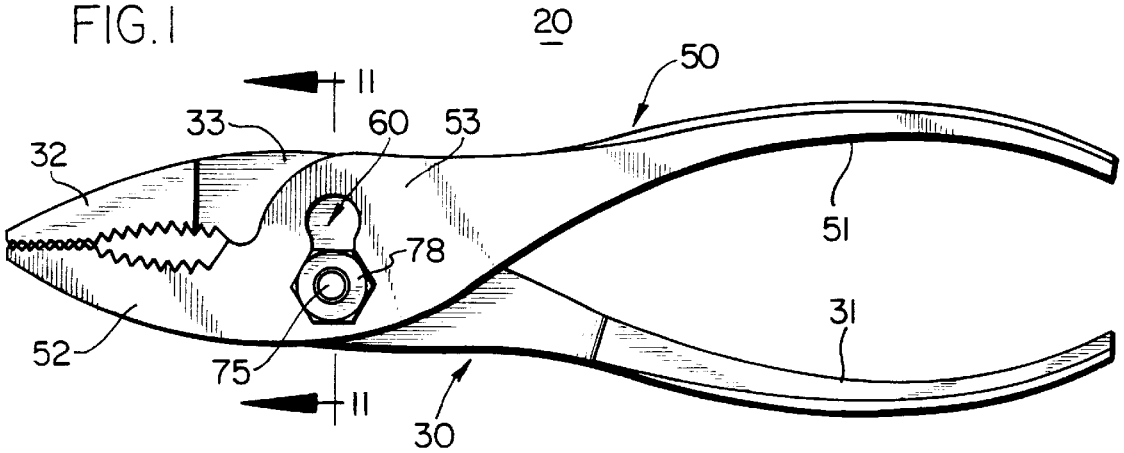
FIG. 1 is a top plan view of a slip-joint pliers constructed in accordance with and embodying the features of the present invention, with the pliers shown in their closed condition and the minimum-opening slip position.

Referring to FIG. 1, there is illustrated a hand tool of the crossed, pivoting lever type, in the nature of a slip-joint pliers 20. The pliers 20 includes crossed levers 30 and 50 pivotally interconnected by a bolt 75 which is threadedly engaged with a nut 78, although other types of pivot arrangements could be used.

Figure 2:
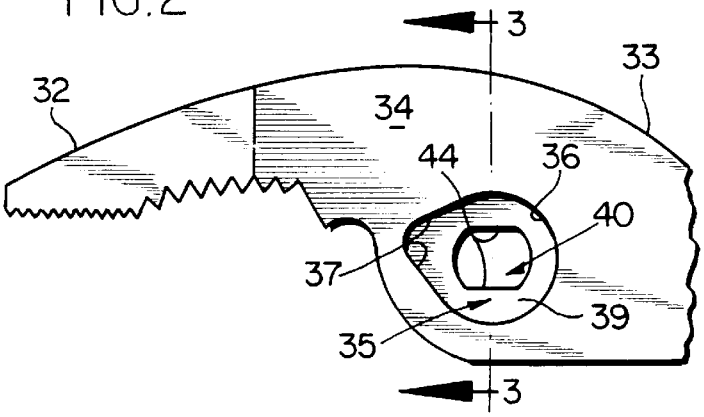
FIG. 2 is an enlarged, fragmentary, top plan view of one of the levers of the pliers of FIG. 2.
Figure 3:
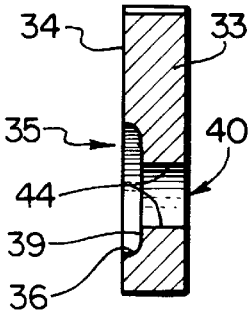
FIG. 3 is a view in vertical section taken along the line 3—3 in FIG. 2.

Referring also to FIGS. 2 and 3, the lever 30 has a handle 31 and a serrated jaw 32 joined by a pivot portion 33 having a flat, planar inner surface 34. Formed in the inner surface 34 is a recess 35, which is generally in the shape of a circle having a generally triangular lobe projecting from one side thereof. The recess 35 has a peripheral side wall 36 with straight bearing portions 37 along the sides of the triangular lobe, the side wall 36 being closed at the bottom of the recess 35 by a flat, planar bottom wall 39 substantially parallel to the inner surface 34. Formed through the pivot portion 33 generally centrally of the recess 35 is an opening 40, substantially in the shape of a circle with diametrically opposed flat sides 44.

Figure 4:
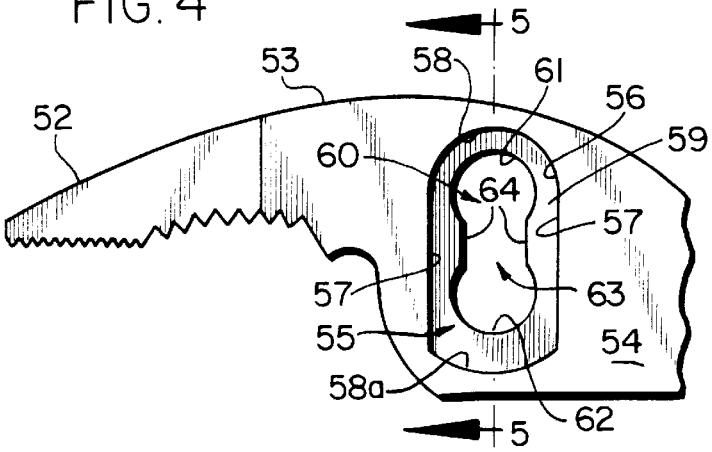
FIG. 4 is a bottom plan view, similar to FIG. 2, of the other lever of the pliers of FIG. 1.
Figure 5:
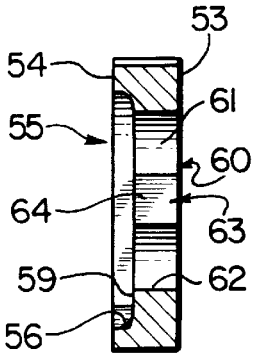
FIG. 5 is a view in vertical section taken along the line 5—5 in FIG. 4.

Referring also to FIGS. 4 and 5, the lever 50 has a handle 51 and a serrated jaw 52 joined by a pivot portion 53 which has a flat, planar inner surface 54. Formed in the inner surface 54 is a recess 55, generally in the shape of an elongated rectangle with arcuate ends. More particularly, the recess 55 has a peripheral side wall 56, which includes straight, parallel bearing portions 57 joined at the opposite ends thereof by arcuate end portions 58 and 58*a,* the latter having a substantially larger radius than the former. The peripheral side wall 56 is closed at the bottom of the recess 55 by a flat, planar bottom wall 59 which is substantially parallel to the inner surface 54. Formed through the pivot portion 53 of the lever 50, generally centrally of the recess 55, is an opening 60 which is generally dumbbell-shaped, having part-circular end portions 61 and 62 joined by a rectangular central portion 63 having flat sides 64. The part-circular portion 61 may be substantially concentric with the arcuate end portion 58 of the recess 55.

It is a significant aspect of the invention that the recesses 35 and 55 are in the shapes of relatively simple, non-reentrant curves. (As used herein, the term "non-reentrant curve" refers to a curve which defines a closed, two-dimensional figure, such that any two points along the curve can be joined by a straight line which does not pass outside the figure.) Furthermore, each recess is a single-level recess which does not require additional formation of bores, steps, counterbores or the like.

Figure 6:
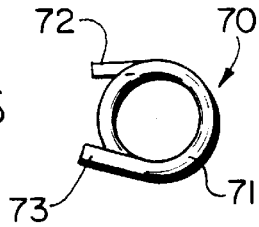
FIG. 6 is an enlarged, top plan view of the bias spring of the pliers of FIG. 1.
Figure 7:
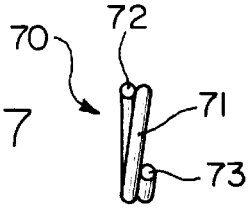
FIG. 7 is a side elevational view of the spring of FIG. 6, taken from the left-hand side thereof.

Referring now also to FIGS. 6 and 7, the pliers 20 also includes a torsion spring 70, preferably including at least one coil or convolution 71, having ends 72 and 73 which extend substantially tangent to the coil 71, and generally in the same direction, and preferably spaced apart a distance less than the diameter of the spring. While any number of convolutions of the spring 70 could be provided, a coil of about 1½ convolutions is preferred, since it is found to provide adequate bias force and at the same time minimizes the depth of spring recess required in the levers 30 and 50.

Referring also to FIGS. 8–11, in assembly a washer 74 is fitted over the shank 77 of the bolt 75 against the head 76 thereof and the shank 77 is fitted upwardly through the opening 40 in the lever 30 until the washer 74 is seated against the outer surface of the lever 30. The shank 77 has a transverse cross section which substantially matches that of the opening 40 in the lever 30, so that the shank 77 is fitted through the opening 40 with the flat sides 79 thereof along the flat sides 44 of the opening. Thus, it will be appreciated that in the assembled condition the lever 30 is inhibited from pivotal or lateral movement relative to the shank 77. Then, the lever 30 may be disposed with its inner surface 34 facing upwardly and the torsion spring 70 is fitted over the shank 77 and seated in the recess 35, so that the end 72 is disposed in the recess 35 and extends along the upper bearing surface 37 thereof, as viewed in FIGS. 2 and 8. While the spring 70 is illustrated with the end 72 seated in the recess 35, it will be appreciated that the spring also could be inverted so that its end 73 is in the recess 35. Then, the lever 50 is crossed over the lever 30 with its inner surface 54 facing the lever 30, so that the bolt shank 77 is received through the opening 60 (e.g., part-circular portion 61) of the lever 50, and the end 73 of the torsion spring 70 is disposed in the recess 55 and lies along the lower one of the bearing portions 57, as viewed in FIG. 8. The nut 78 is then engaged with the bolt 75 to secure the parts together in a known manner, in the normally-open condition of FIG. 8.

Figure 8:
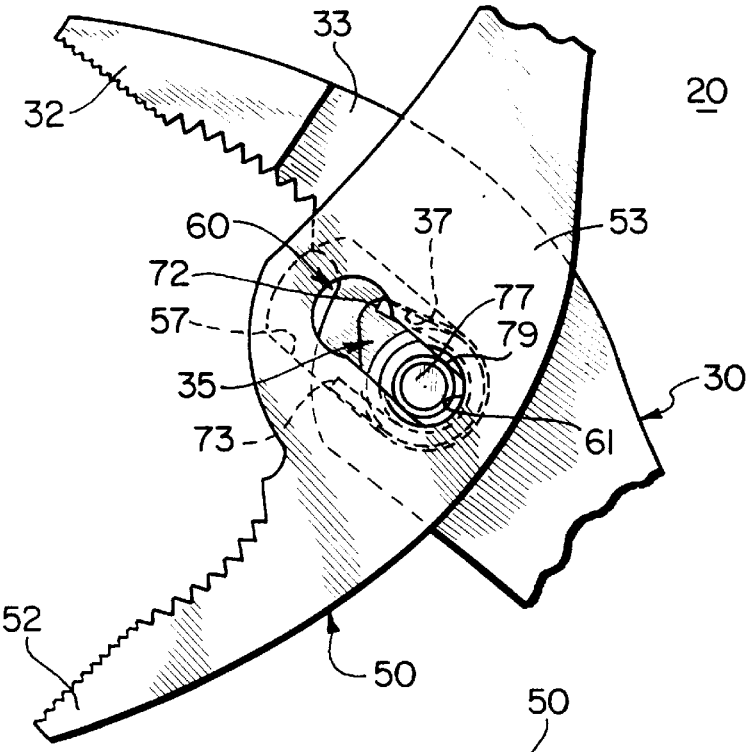
FIG. 8 is an enlarged, fragmentary view of the pliers of FIG. 1 in their normally-open condition.
Figure 9:
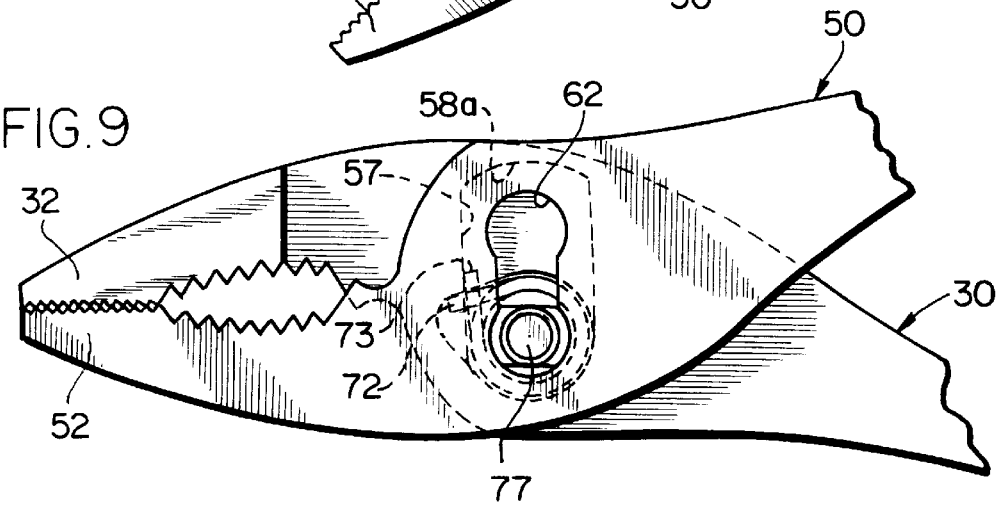
FIG. 9 is an enlarged, fragmentary view of the left-hand portion of the pliers of FIG. 1.
Figure 10:
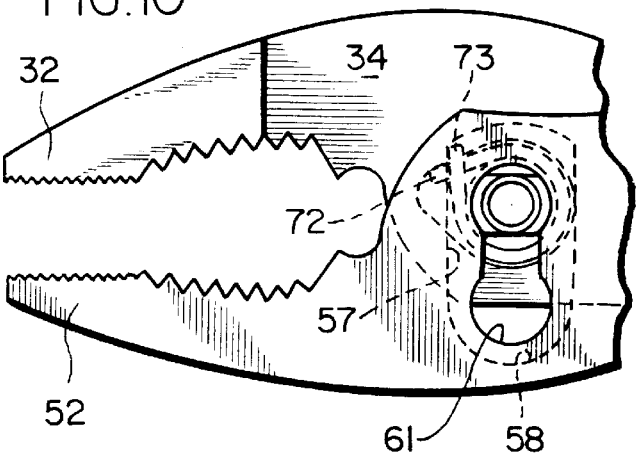
FIG. 10 is a view similar to FIG. 9, with the pliers shown in their minimum opening slip position.
Figure 11:
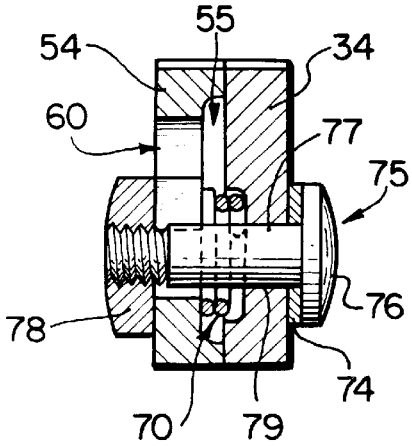
FIG. 11 is an enlarged view in vertical section taken along the line 11—11 in FIG. 1.

In operation, the pliers 20 are closed to the position illustrated in FIG. 9 by moving the handles 31 and 51 together, in a known manner, against the urging of the torsion spring 70. FIGS. 1, 8 and 9 illustrate the minimum opening position of the lever 50 and, when in this position, the jaws 32 and 52 contact each other when closed. If it is desired to shift the lever 50 to the maximum opening position, the pliers are first allowed to move to their open condition under the urging of the torsion spring 70, as illustrated in FIG. 8, then the lever 50 is slid downwardly along the flat sides 79 of the bolt shank 77 until the shank 77 extends through the part-circular portion 62 of the opening 60. Then, when the pliers are closed, as illustrated in FIG. 10, the jaws 32 and 52 will be spaced apart, in a known manner. It is significant that the recess 55 and, in particular the bearing portions 57 thereof, have a sufficient length so that the end 73 of the torsion spring 70 remains in bearing engagement therewith irrespective of the lateral position of the lever 50, so that the pliers 20 will always be biased to their open condition.

From the foregoing, it can be seen that there has been provided an improved slip-joint pliers of the spring-biased type, wherein the spring is a simple, helical, torsion spring with tangent ends and is seated in recesses in the lever members which are of simple, non-reentrant shapes and of single depth. While the invention has been disclosed as used in pliers, it will be appreciated that it has application to other pivoting lever tools.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A hand tool comprising:

first and second crossed levers respectively having facing first and second inner surfaces and first and second openings respectively formed through said first and second levers at said first and second inner surfaces, a pivot shaft extending through said openings for pivotally interconnecting said levers, first and second recesses respectively formed in said inner surfaces and respectively surrounding said openings, said first and second openings having different sizes and shapes and said first and second recesses having different sizes and shapes.

each of said recesses having a peripheral side wall including a substantially flat planar bearing portion and a substantially flat planar bottom wall extending from said side wall to the associated opening, and a bias spring disposed in said recesses and having first and second ends respectively engaging said bearing portions for resiliently pivotally urging said levers to a predetermined condition.

2. The hand tool of claim 1, wherein said levers cooperate to define a pliers tool.

3. The hand tool of claim 1, wherein said spring cooperates with said levers to bias them to an open condition.

4. The hand tool of claim 1, wherein said pivot shaft includes a bolt, and further including a nut threadedly engaged with said bolt for holding said levers together.

5. The hand tool of claim 1, wherein said bias spring is a torsion spring.

6. The hand tool of claim 5, wherein said torsion spring includes at least one helical coil encircling said shaft, said ends being substantially tangent to said at least one helical coil.

7. The hand tool of claim 1, wherein said first and second inner surfaces are substantially flat, planar surfaces and are respectively substantially parallel to said bottom walls of said first and second recesses.

8. The hand tool of claim 1, wherein each of said recesses is in the shape of a non-reentrant curve.

9. A slip-joint pliers comprising:

first and second crossed levers respectively having facing first and second inner surfaces and first and second openings respectively formed through said first and second levers at said first and second inner surfaces, a pivot shaft extending through said openings for pivotally interconnecting said levers, first and second recesses respectively formed in said inner surfaces and respectively surrounding said openings, said first opening being shaped and dimensioned to prevent lateral movement of said first lever relative to said shaft, said second opening being shaped and dimensioned to accommodate lateral movement of said second lever relative to said shaft, each of said recesses having a peripheral side wall including a substantially flat planar bearing portion and a substantially flat planar bottom wall extending from said side wall to the associated opening, and a bias spring disposed in said recesses and having first and second ends respectively engaging said bearing portions for resiliently pivotally urging said levers to a predetermined condition, said bearing portion of said second recess having a length sufficient to remain in contact with said second end of said spring irrespective of the lateral position of said second lever relative to said shaft.

10. The pliers of claim 9, wherein said pivot shaft includes a bolt, and further including a nut threadedly engaged with said bolt for holding said levers together.

11. The pliers of claim 9, wherein said bias spring is a torsion spring.

12. The pliers of claim 11, wherein said torsion spring includes at least one helical coil encircling said shaft, said ends being substantially tangent to said at least one helical coil.

13. The pliers of claim 9, wherein said spring cooperates with said levers to bias them to an open condition.

14. The pliers of claim 9, wherein said first and second inner surfaces are substantially flat, planar surfaces and are respectively substantially parallel to said bottom walls of said first and second recesses.

15. The pliers of claim 9, wherein said shaft is non-circular in transverse cross section and cooperates with said first opening to prevent rotational movement of said first lever relative to said shaft.

16. The pliers of claim 9, wherein said first recess has a part-circular shape with a generally triangular lobe projecting from one side thereof, said bearing portion being formed on said lobe, said second recess being elongated and having a pair of parallel flat sides joined by arcuate end portions with said bearing portion being defined on one of said flat sides.

17. A hand tool comprising:

first and second crossed levers respectively having facing first and second inner surfaces and an opening formed through said second lever at said second inner surface, a pivot shaft coupled to said first lever for pivotally interconnecting said levers, first and second recesses respectively formed in said inner surfaces with said second recess surrounding said opening, said first and second recesses having different sizes and shapes, each of said recesses having a peripheral side wall including a substantially flat planar bearing portion and a substantially flat planar bottom wall with the bottom wall of said second recess extending from its side wall to the opening, and a bias spring disposed in said recesses and having first and second ends respectively engaging said bearing portions for resiliently pivotally urging said levers to a predetermined condition.

18. The hand tool of claim 17, wherein said opening is shaped and dimensioned to accommodate lateral movement of said second lever relevant to said shaft, said bearing portion of said second recess having a length sufficient to remain in contact with said second end of said spring irrespective of the lateral position of said second lever relative to said shaft.

* * * * *